United States Patent [19]

Stewart et al.

[11] 4,393,291

[45] Jul. 12, 1983

[54] GAS BLAST INTERRUPTERS

[75] Inventors: John S. Stewart, West Bridgford; Stanislaw M. Gonek, Long Eaton, both of England

[73] Assignee: Brush Switchgear Limited, England

[21] Appl. No.: 180,340

[22] Filed: Aug. 22, 1980

[30] Foreign Application Priority Data

Oct. 12, 1979 [GB] United Kingdom ..... 7935551

[51] Int. Cl.[3] ..... H01N 33/70

[52] U.S. Cl. ..... 200/148 R; 200/148 A; 200/146 R

[58] Field of Search ..... 200/148 R, 148 A, 146 R

[56] References Cited

U.S. PATENT DOCUMENTS 4,112,276 9/1978 Cromer et al. ..... 200/148 A
4,182,942 1/1980 Koyanagi et al. ..... 200/148 A
4,236,053 11/1980 Sasaki et al. ..... 200/148 A

FOREIGN PATENT DOCUMENTS 1086519 8/1954 France ..... 200/148 R

*Primary Examiner*—Robert S. Macon
*Attorney, Agent, or Firm*—Laff, Whitesel, Conte & Saret

[57] ABSTRACT

A gas-blast type interrupter comprises first and second electrodes relatively movable between a closed position in which they are in mutual electrical engagement and an open position in which they are mutually separated, movement of the electrodes towards their open position causing an arc to be drawn therebetween. A tubular housing encloses the first electrode and has therein a first insulating orifice through which the second electrode substantially sealingly passes when the electrodes are in their closed position. A guide surrounds the tubular member and has therein a second insulating orifice through which the second electrode also substantially sealingly passes when the electrodes are in their closed position, the first and second orifices being co-axial and of essentially the same size. The tubular housing and the guide define therebetween an annular chamber to which pressurized gas is supplied upon movement of the electrodes towards their open position, so that when the second electrode passes out of the first insulating orifice pressurized gas is permitted to flow therethrough into the interior of the tubular member in a direction essentially along said arc, and when the second electrode subsequently passes out of the second insulating orifice the pressurized gas is permitted to flow therethrough from the annular chamber in the opposite direction to the gas flowing through the first orifice.

8 Claims, 14 Drawing Figures

GAS BLAST INTERRUPTERS

This invention relates to interrupters of the gas-blast type.

Such interrupters are required to carry the rated currents in the closed position and interrupt the electrical power circuit by drawing an arc between a pair of axially co-operating electrodes where it can be extinguished by the scavenging and de-ionising action of a flow of gas directed essentially along the arc. It is preferred that these interrupters should also be able to isolate the circuit in the open position, close onto the rated currents and that their current carrying ability should not be impaired by arcing on interruption or by pre-arcing on closure of the circuit.

In order to achieve an efficient interruption and limit the duration of arcing or pre-arcing, relatively high operating speeds must be achieved on contact parting or approaching movements of the co-operating electrodes. Measures must also be taken to protect the current carrying contacts against erosion by the arc so that their current carrying ability is not impaired by repetitive opening and closing operations of the interrupter.

Hitherto, attempts to overcome the above problems have been embodied in three basic constructions of gas-blast interrupter, all of which permit the contacts initiating the arc to accelerate from rest and part at speed on interruption and to touch and flow through at speed on closing. One of these constructions permits the arc to be initiated on one set of contacts which is also required to carry the rated currents and thereby is not protected against erosion unless another set of contacts is provided externally to the interrupting zone and in parallel with the arcing contacts. These external contacts tend to reduce the inherent dielectric strength outside the interrupting zone, and require larger diameter enclosures to be used. The second of these basic constructions employs a movable auxiliary contact which, whilst affording protection, must be separately driven by spring or pressure forces with the attendant drawbacks in simplicity and reliability.

Furthermore, in the case of the so-called "duoblast" type interrupters, in which the arc is subtended through a pair of nozzles, none of the three constructions readily permit both nozzles to be made of a suitable insulating material to enhance the interrupting and the isolating capabilities of the interrupter.

It is an object of the present invention to obviate or mitigate the above-described problems.

According to the present invention, there is provided a gas-blast type interrupter comprising first and second electrodes relatively movable between a closed position in which they are in mutual electrical engagement and an open position in which they are mutually separated, movement of the electrodes towards their open position causing an arc to be drawn therebetween in use, a tubular housing enclosing the first electrode and having therein a first insulating orifice through which the second electrode substantially sealingly passes when the electrodes are in their closed position, a guide surrounding the tubular member and having therein a second insulating orifice through which the second electrode also substantially sealingly passes when the electrodes are in their closed position, the first and second orifices being co-axial and of essentially the same size, the tubular housing and the guide defining therebetween an annular chamber to which pressurised gas is supplied upon movement of the electrodes towards their open position, such that when the second electrode passes out of the first insulating orifice said pressurised gas is permitted to flow therethrough into the interior of the tubular member in a direction essentially along said arc, and when the second electrode subsequently passes out of the second insulating orifice said pressurised gas is permitted to flow therethrough from the annular chamber in the opposite direction to the gas flowing through the first orifice.

This arrangement enables the axial spacing of the two orifices to be set to give optimum aerodynamic conditions for the gas flow, and also allows the electrostatic conditions to be set readily in the fully open position of the electrodes.

Preferably, an annular space defined between the first electrode and the tubular housing communicates with a gas exhaust passage, and an end of the first electrode which co-operates with the second electrode is tubular and has venting spaces therein through which gas flowing through the first orifice can pass. This ensures that the gas can flow axially of the arc when the second electrode passes out of the first insulating orifice, so that the arc column is effectively cooled and de-ionised.

In one embodiment of the invention, an end of the first electrode includes a first tubular portion surrounding a probe, the co-operating end of the second electrode includes a second tubular portion, and when the electrodes are in their closed position a first set of contact formations on the first tubular portion slidably engage the second tubular portion and a second set of contact formations on the second tubular portion slidably engage the probe, such that the movement of the electrodes towards their open position causes the contact formations on one electrode to disengage from the other electrode while the contact formations on the other electrode remain engaged with said one electrode, and subsequently causes the contact formations on the other electrode to disengage also, thereby initiating said arc.

In an alternative embodiment, an end of the first electrode which co-operates with the second electrode is tubular, and when the electrodes are in their closed position the second electrode is slidably engaged by two sets of contact formations on said tubular end of the first electrode, the sets of contact formations being spaced apart axially of said tubular end, such that movement of the electrodes towards their open position causes one set of contact formations to disengage from the second electrode while the other set remain engaged therewith, and subsequently causes the other set of contact formations to disengage from the second electrode also, thereby initiating said arc. In this case, the venting spaces can be provided between the two sets of contact formations.

In one arrangement, the tubular end of the first electrode is composed of a plurality of axial fingers arranged in an annulus, some of the fingers which are angularly spaced apart around said tubular end being axially extended and carrying said one set of contact formations, the remaining fingers carrying said other set of contact formations.

In an alternative arrangement, the tubular end of the first electrode is composed of an inner tubular member having a plurality of fingers arranged in an annulus and carrying said other set of contact formations, and an outer tubular member co-axial with the inner tubular member and having a plurality of fingers which extend axially beyond said other set of contact formations and which carry said one set of contact formations.

The gas used in the interrupter can be sulphur hexafluoride, which is highly insulating.

The present invention will now be further described, by way of example, with reference to the accompanying drawings, in which.

Figure 1:
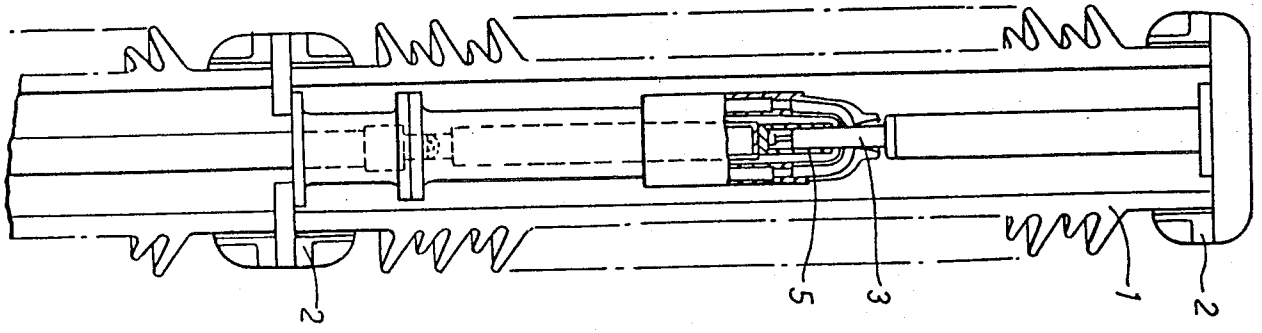
FIG. 1 is a part sectional view of a first embodiment of a gas-blast type interrupter according to the present invention, showing the interrupter in a closed position.
Figure 2:
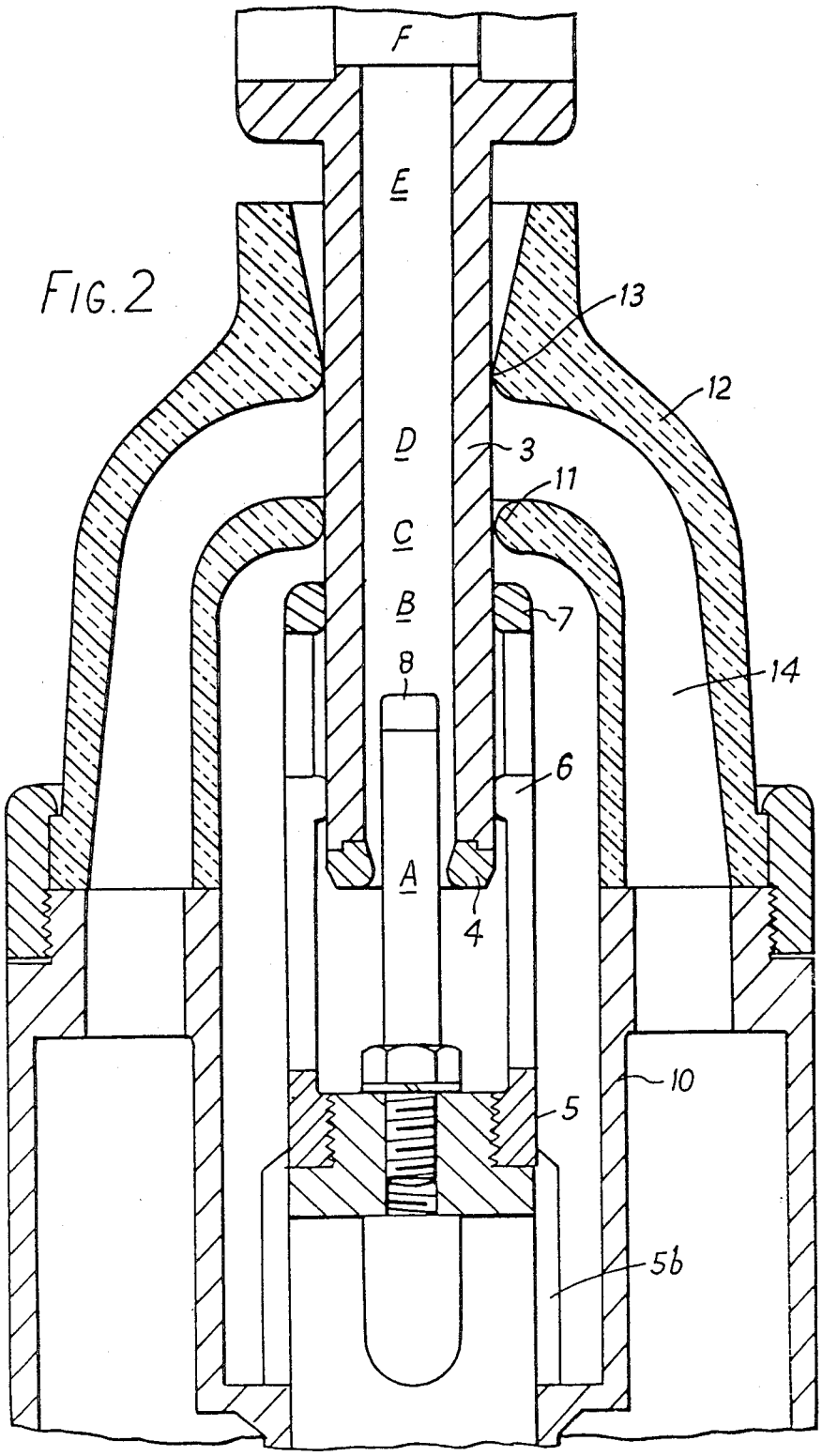
FIG. 2 is an enlarged view of a portion of the interrupter shown in FIG. 1.
Figure 3A:
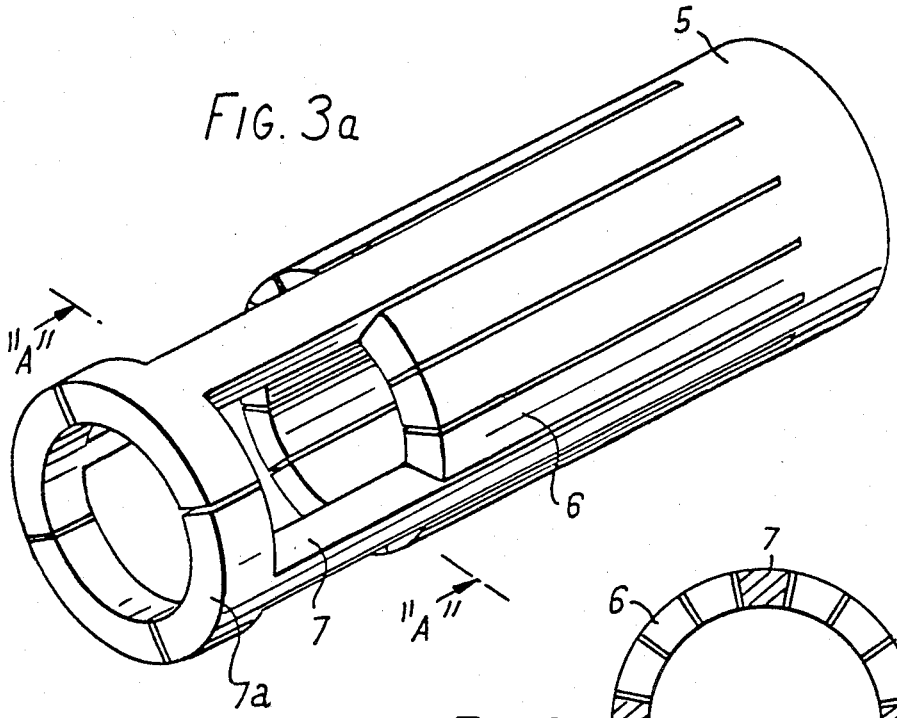
Figure 3B:
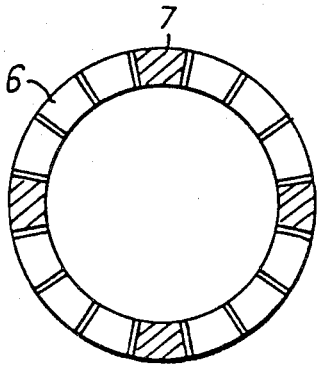

FIG. 3*a* is a perspective view of one electrode of the interrupter shown in FIGS. 1 and 2;

FIG. 3*b* is a section along the line A—A in FIG. 3*a;*

Figure 3C:
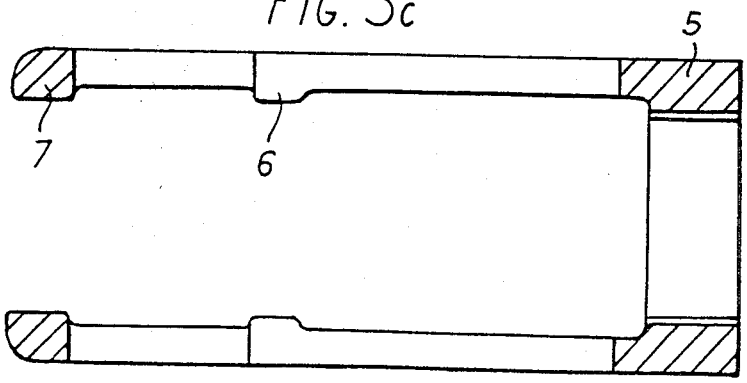

FIG. 3*c* is a longitudinal section through the electrode shown in FIG. 3*a;*

Figure 4:
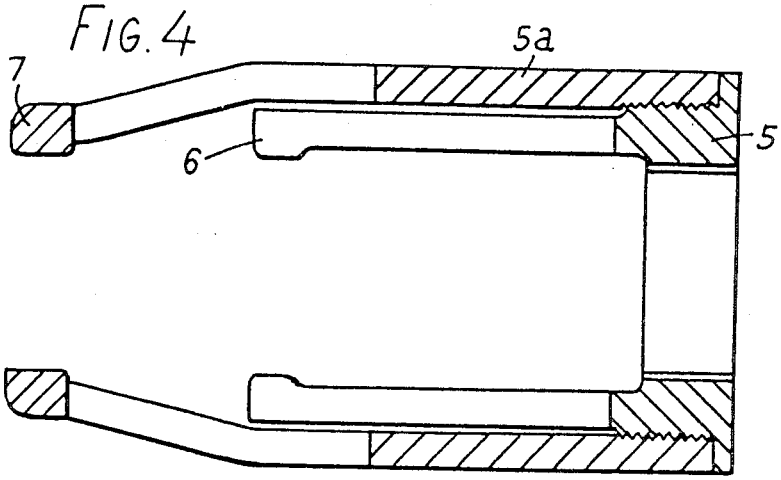
Figure 5A:
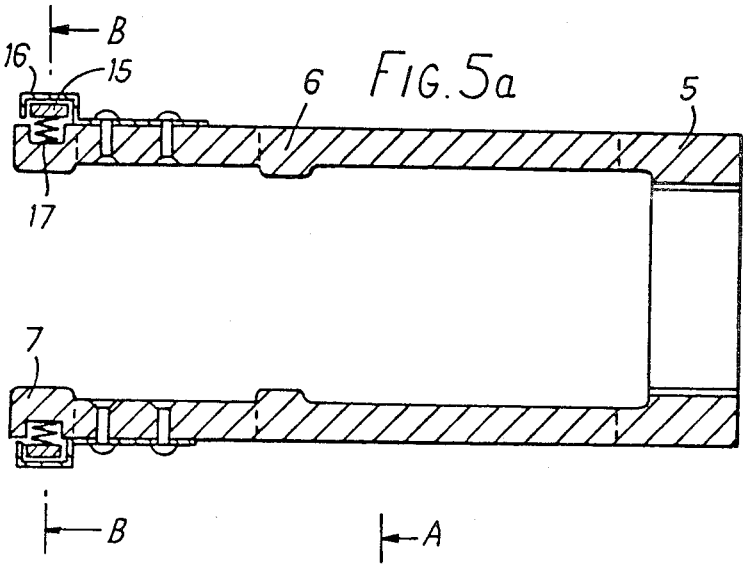
Figure 5B:
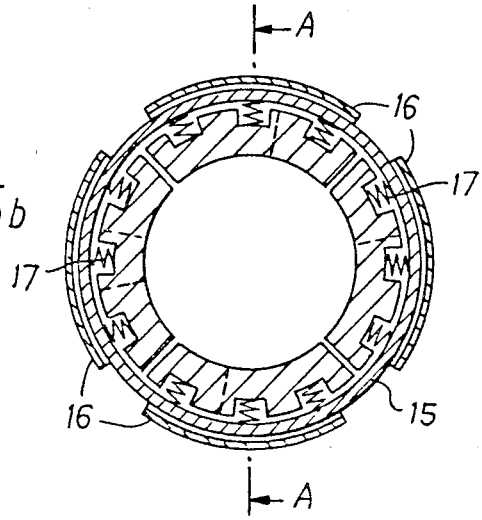

FIG. 4 is a similar view to FIG. 3*c* but showing a modified form of electrode;

FIG. 5*a* is a similar view to FIG. 3*c* but showing a further modified form of electrode;

FIG. 5*b* is a section taken along the line B—B in FIG. 5*a;*

Figure 8:
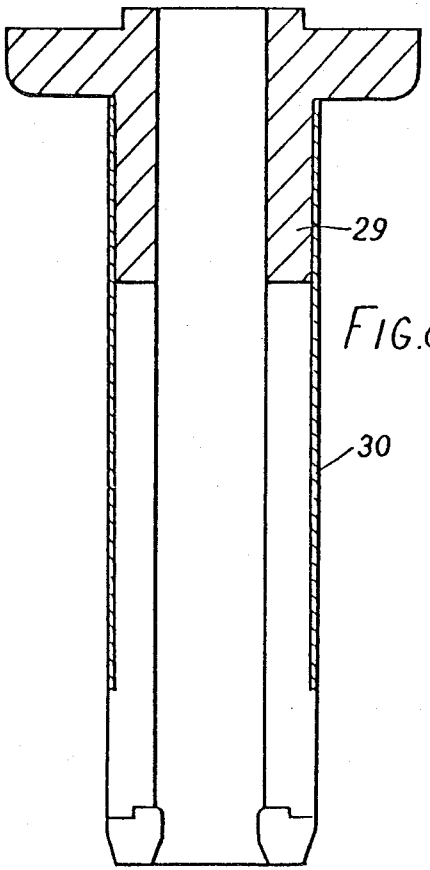
Figure 6B:
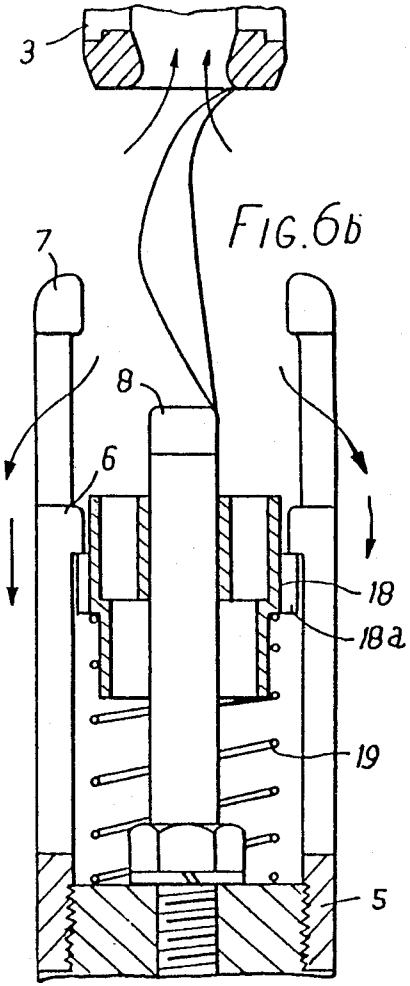
Figure 6A:
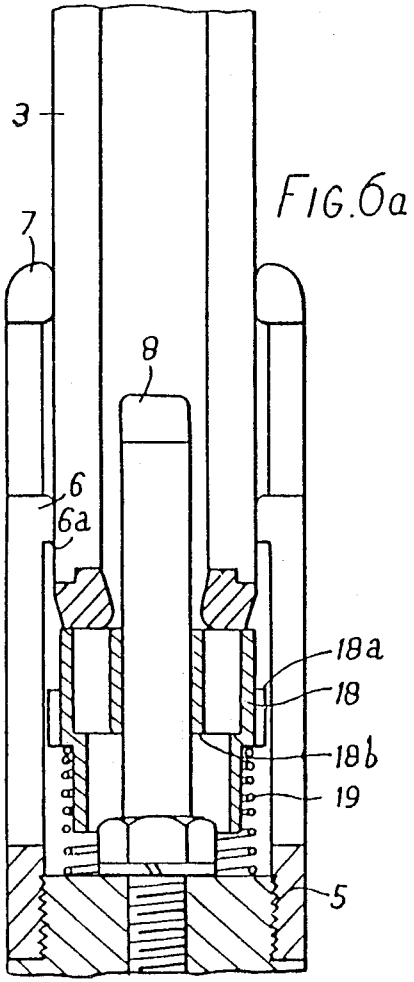
Figure 7:
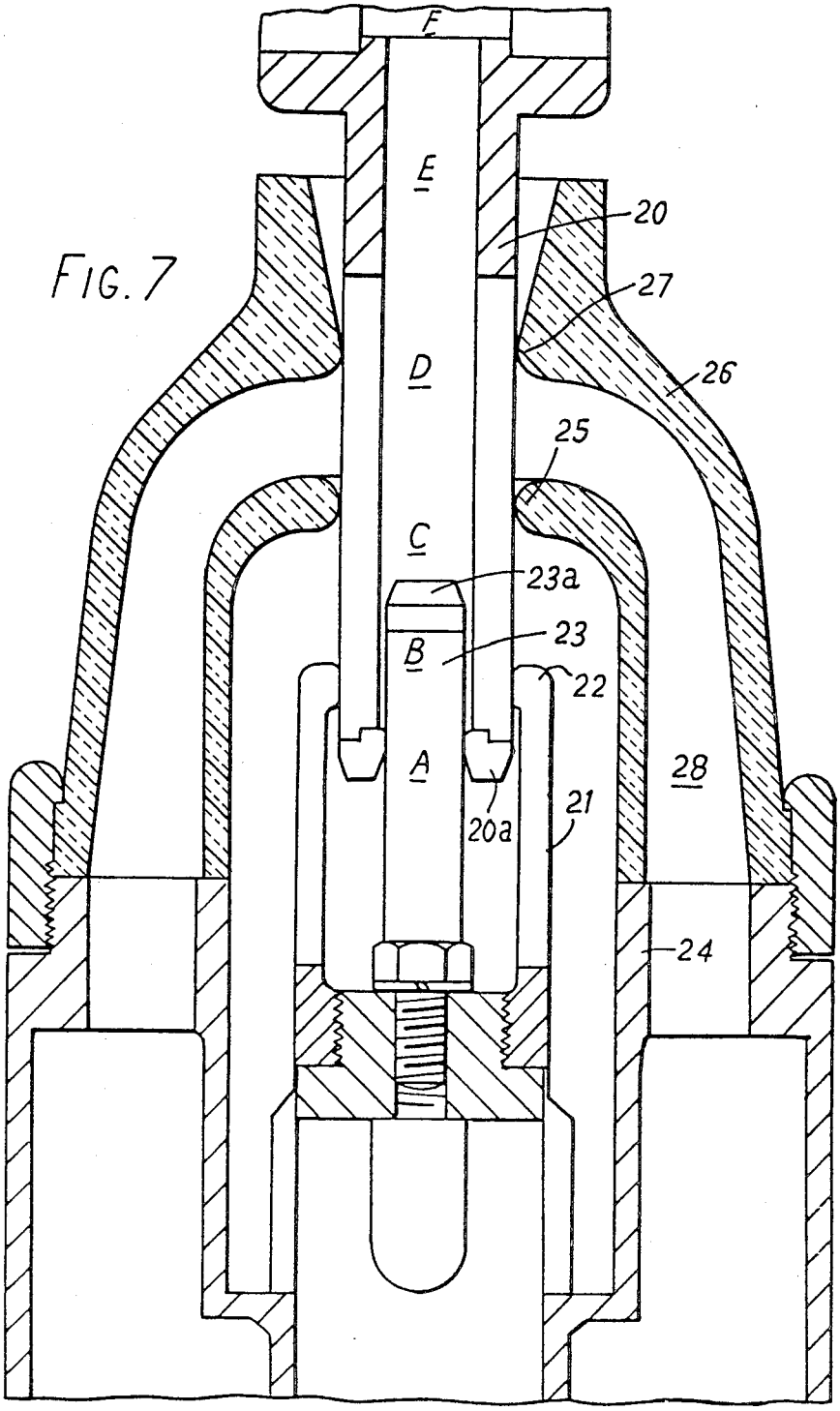
Figure 9:
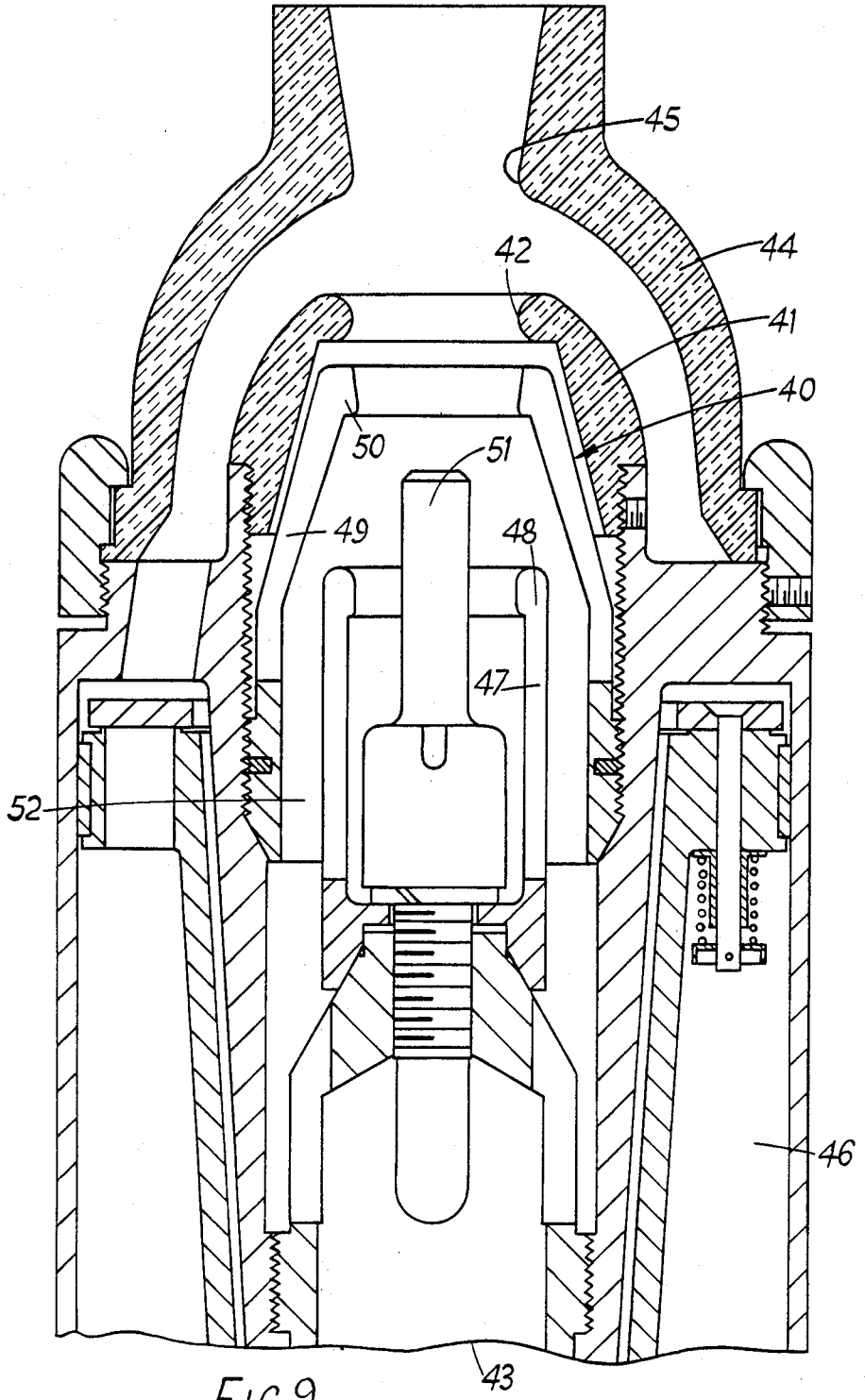
Figure 10:
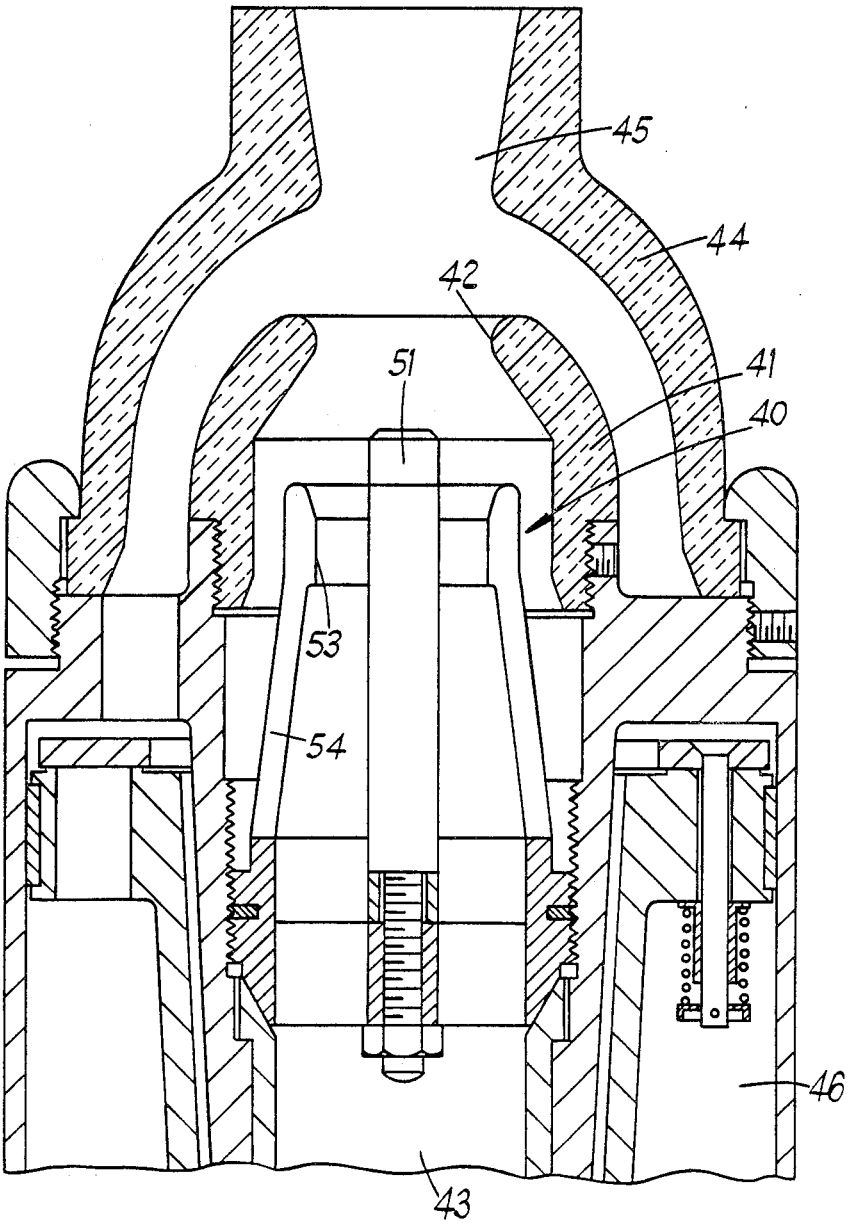

FIG. 6*a* is a partial section through a portion of a second embodiment of a gas-blast type interrupter according to the present invention, showing the interrupter in a closed position;

FIG. 6*b* is a similar view to FIG. 6*a* but showing the interrupter in an open position;

FIG. 7 is a similar view to FIG. 2 of a third embodiment of a gas-blast type interrupter according to the present invention, the interrupter being shown in a closed position;

FIG. 8 is a longitudinal section through an alternative form of downstream electrode for the interrupter of FIG. 7;

FIG. 9 is a sectional view of an upstream electrode assembly which forms part of a forth embodiment of a gas-blast type interrupter according to the present invention; and FIG. 10 is a sectional view of an upstream electrode assembly which forms part of a fifth embodiment of a gas-blast type interrupter according to the present invention.

Referring first to FIGS. 1 and 2, the interrupter shown therein is of the open terminal, procelain enclosed form and is part of one phase of a three-phase circuit breaker. The interrupter comprises an insulating enclosure 1 having a flange 2 at each end thereof and housing a pair of relatively movable co-operating electrodes 3 and 5. The electrode 3 is formed by a hollow tubular conductor whose internal passage at the co-operating end is reduced to form an orifice 4, henceforth referred to as an auxiliary nozzle. The other end of the passage communicates with a space remote from the co-operating end.

The electrode 5 is formed by a larger hollow tubular conductor terminating at the co-operating end in two sets of contacts 6 and 7 which in the closed position of the interrupter, are resiliently biased into contact with the electrode 3. The set of contacts 6 engages the electrode 3 in proximity to the auxiliary nozzle 4, the set of contacts 7 engaging the electrode 3 at a distance from the nozzle 4 and overlapping the engagement of the contacts 6. The contact set 7 can form an imcomplete annulus with a venting space located between the points of engagement of the contact sets 6 and 7 with the electrode 3 permitting gas to flow without undue restriction in the radial direction. A metal probe 8, disposed on the axis of the electrodes and connected to electrode 5, terminates at a position between the contact sets 6 and 7.

The electrode 5 is immovably coupled to and enclosed in a tubular housing 10 which overlaps the contacts sets 6 and 7 and which has an insulating orifice 11 in one end thereof through which the electrode 3 substantially sealingly passes when the interrupter is in its closed position. An annular space defined between the electrode 5 and the housing 10 communicates with an exhaust passage 5*b* at ane end of the housing 10 remote from the orifice 11. The housing 10 may be made wholly of metal or of an electrically insulating material, or only one end may be made of insulating material.

The housing 10, the electrode 5 and the probe 8 are immovably coupled to and enclosed in a tubular gas flow guide 12 having an insulating orifice 13 in one end thereof through which the electrode 3 substantially sealingly passes when the interrupter is in its closed position. The orifice 13 is co-axial with and the same size as the orifice 11. An annular passage 14 defined between the guide 12 and the housing 10 communicates with a supply of compressed gas produced or stored at a higher pressure than present in the remainder of the enclosure 1. The gas is a highly insulating gas, such as sulphur hexafluoride.

Referring to the electrode 5 and its immovably coupled components 8, 10 and 12 as the up-stream electrode assembly and to the electrode 3 as the down-stream electrode, the operation of the interrupter is as follows:

Starting with the interrupter closed as shown in FIG. 2, and the current flowing between the up-stream electrode assembly and the down-stream electrode through the contacts sets 7 and 6, an initial movement of the electrode 3 relative to the electrode 5 from the position A shown to the position indicated at B in FIG. 2 causes the current flowing through the contact set 6 to be readily commuted to the contact set 7 by virtue of the negligible or very small electro-magnetic energy stored in the commutating loop formed between the two contact sets. This initial movement permits the electrodes to accelerate to the required relative velocity without a loss of contact while the compressed gas is allowed to fill the annular passage 14 whose exit is restricted at this stage by the electrode 3 in co-operation with the orifices 11 and 13.

Further movement to the position indicated at C causes the auxiliary nozzle 4 to disengage from the contact set 7 so that an arc is initiated therebetween. Both the contact set 7 and the auxiliary nozzle 4 are manufactured from erosion resistant material, such as copper tungsten.

Upon further movement to the position indicated at D, the electrode 3 passes out of the orifice 11 and allows the compressed gas to flow from the annular passage 14 through the orifice 11 and thereby influence the arc drawn between the set of contacts 7 and the auxiliary nozzle 4 to transfer its root from the set of contacts 7 to the probe 8. The compressed gas is free to flow through the space provided between the contact sets 6 and 7 to the annular space between the electrode 5 and the housing 10 and thence to the exhaust passage 5*b* thus acting axially on the arc subtended between the probe 8 and the auxiliary nozzle 4 to cool and de-ionise the arc column.

Upon movement to the position indicated at E, the electrode 3 passes out of the orifice 13 and allows compressed gas to flow through the latter in the opposite direction to the gas flowing through the orifice 11. The arc is thereby subjected to action by gas flow in opposite directions in accordance with the duo-blast principle. The construction of the interrupter enables the axial spacing of the orifices 11 and 13 to be set to give optimum aerodynamic conditions for the gas flow.

Finally, when the electrode 3 is in the position indicated at F in FIG. 2 the interrupter is in the fully open position with both electrodes at rest. In this position the flow of compressed gas has ceased and the pressure surrounding the interrupter is maintained at a level necessary to ensure an adequate voltage strength is maintained between the electrodes. Again, the construction of the interrupter enables the electrostatic conditions to be readily set when the electrodes are in this position.

The gas passage between the contact sets 6 and 7 is shown in greater detail in FIGS. 3*a* to 3*c*. Alternative constructions can however, be used to permit the above-mentioned gas flow to take place. By way of example only, an alternative construction is shown in FIG. 4. In this example, the hollow tubular electrode 5 has, at the end thereof which co-operates with electrode 3, a number of resiliently biased contacts 6. Concentric with electrode 5 is another tubular electrode 5*a* having a reduced number of resiliently biased contacts 7 in the form of an incomplete annulus, arranged to engage the electrode 3 in spaced relation to the contacts 6. The gas passage is provided by the space between the contacts 7 and 6.

The magnitude of the current to be passed through the electrodes 5 and 3 may be such that insufficient load can be obtained from the natural resilience of the contacts 7 and the electromagnetic forces to prevent erosion at the contact face. FIGS. 5*a* and 5*b* show a means of increasing the load at the contact face by means of springs. A short annular tube 15, preferably of nonmagnetic material, is arranged to encircle the electrode 5 in the proximity of the contacts 7 and is retained by a keeper 16 preferably connected to the contacts 7. A number of helical springs 17 set into recesses in the electrode 5, immediately beneath the annular tube 15, are arranged so that the spring load reaction against the annular tube 15 is transmitted to the contacts 7, thereby argumenting the natural resilience of the contacts 7 and thus increasing the current carrying ability of the electrode system.

During the interruption of the flow of very high short-circuit currents additional protection may be required for the surfaces of contacts. A means of providing this protection is shown in FIGS. 6*a* and 6*b*. The hollow tubular electrode 5 is arranged to include a sliding sleeve 18 having a bearing guide 18*a* in sliding engagement with the metal probe 8, the sleeve 18 being preferably manufactured from a non-metallic material such as polycarbonate or P.T.F.E. A helical spring 19 is arranged to bias the sleeve 18 towards the co-operating end of the hollow tubular electrode 3. FIG. 6*a* shows the position adopted by the sleeve when the electrodes 5 and 3 are in full engagement, the sleeve 18 being depressed within the hollow tubular electrode 5 by the electrode 3 compressing the spring 19. During the opening movement of the electrodes, the sleeve 18 is maintained in butt contact with the electrode 3 until the bearing guide 18*a* comes into contact with a stop 6*a* on the contact set 6, as shown in FIG. 6*b*, thus providing protection to the contact surfaces during the remainder of the iterrupting process.

An alternative form of the interrupter to that shown in FIG. 2 is shown in the closed position in FIG. 7. A relatively stationary electrode 20 is formed by a hollow tubular conductor terminating at one end thereof in a plurality of resiliently biased contacts 20*a* which engage a metal probe 23. The internal bore of the electrode 20 forms a gas vent passage which communicates with a space remote from the contacts 20*a*. External to and concentric with the metal probe 23 is a hollow tubular electrode 21 which also terminates in a plurality of resiliently biased contacts 22, these contacts engaging the electrode 20 in spaced relation to the contacts 20*a*. The metal probe 23 and the hollow tubular electrode 21 are immovably coupled to and enclosed by a tubular housing 24 which overlaps both contact sets 20*a* and 22 and which has an insulating orifice 25 in one end thereof through which the electrode 20 passes. An annular space defined between the electrode 21 and the housing 24 communicates with an exhaust passage at an end of the housing 24 remote from the orifice 25. The housing 24 may be made wholly of metal or of an electrically insulating material, or only one end may be made of insulating material.

The housing 24, the electrode 21 and the probe 23 are immovably coupled to and enclosed by a tubular gas flow guide 26 which has an insulating orifice 27 at one end thereof through which the electrode 20 passes. The orifice 27 is co-axial with the same size as the orifice 25. An annular passage 28 defined between the housing 24 and the gas flow guide 26 communicates with a supply of compressed gas produced or stored at a higher pressure than present in the remainder of the enclosure (not shown but similar to that of FIG. 1) which contains the electrode assembly. Again, the gas is highly insulating, and is preferably sulphur hexafluoride.

Referring to the electrode 21 and its immovably coupled components 23, 24 and 26 as the up-stream electrode assembly and the electrode 20 as the down-stream electrode, the operation of the interrupter is as follows:

When the interrupter is in its closed position, the electrode 20 is at the position indicated by A in FIG. 7 and current flows between the upstream electrode assembly and the downstream electrode through contacts 22 and 20*a*. An initial movement of the electrode 20 relative to the electrode 21 to the position indicated at B in FIG. 7 causes the current flowing through the contacts 22 to be readily commuted to the probe 23 by virtue of the negligible or very small electro-magnetic energy stored in the commutating loop formed by the two contact sets 20*a* and 22. This initial movement permits the electrodes to accelerate to the required velocity without a loss of contact while compressed gas is allowed to fill the annular passage 28 whose exit is restricted at this stage by the electrode 20 in co-operation with the orifices 25 and 27.

Further movement to the position indicated at C in FIG. 7 causes the contact set 20*a* to disengage from the probe 23, thereby initiating an arc between the erosion resistant end 23*a* of the probe 23 and the erosion resistant contacts 20*a* of the downstream electrode 20, whilst a further increase in gas pressure takes place within the annular passage 28.

Upon further movement to the position indicated at D in FIG. 7, the electrode 20 passes through the orifice 25 and thereby allows the gas which has accumulated at pressure in the annular space 28 to be accelerated and flow at high velocity through the orifice 25. The gas flow thus acts axially on the arc subtended between the probe end 23*a* and the contacts 20*a* to cool and de-ionise the arc column. The exhaust gases are free to flow down the annular space between the electrode 21 and the housing 24.

Movement to the position indicated at E in FIG. 7 causes the orifice 27 also to be opened to the high pressure gas stored in the annular passage 28 giving a full duo-blast action, that is, accelerating the gas and causing it to flow in two directions axially along the length of the arc to cool and de-ionise, resulting in arc extinction at a natural current zero. As in the embodiment of FIG. 2, the construction of the interrupter enables the axial spacing between the two orifices 25 and 27 to be set for optimum aerodynamic conditions for the gas flow.

F in FIG. 7 indicates the position of the electrodes 20 with the interrupter in the fully open position and the movable assembly at rest. In this position the high pressure gas that has accumulated in the annular passages 28 is exhausted and the ambient pressure surrounding the interrupter is maintained to ensure an adequate voltage withstand level exists in the gap between the downstream electrode and the upstream electrode assembly. As in the embodiment of FIG. 2, the construction of the interrupter enables the electrostatic conditions to be readily set when the electrodes are in their fully open position.

To maximise the performance of the interrupter shown in FIG. 7 the downstream electrode 20 can be replaced by an electrode assembly 29 and 30 shown in FIG. 8. The electrode 29 is similar in construction to the electrode 20, except that for the major portion of its length it is recessed to accept a relatively thin tube 30 of thermoplastic material, such as heat shrinkable P.T.F.E. sleeving. The effect of this tube 30 is to restrict premature gas loss from the annular space 28 via the spaces between the plurality of resiliently biased contacts at the co-operating end of electrode 29 during the initial movement of the interrupter as shown at B, C and D in FIG. 7.

A downstream electrode assembly forming part of another embodiment of the invention is shown in FIG. 9, and comprises an electrode 40 which is engageable with a fixed electrode similar to the electrode 3 shown in FIG. 2. The electrode 40 is enclosed by a tubular housing 41 having an insulating orifice 42 therein, the interior of the tubular member 41 communicating with a gas exhaust passage 43. The tubular member 41 is in turn surrounded by a guide 44 having a further insulating orifice 45 therein, the guide and the tubular member defining therebetween an annular passage 46 to which pressurised gas is supplied in use. The orifices 42 and 45 are co-axial and of the same size, and the aforementioned fixed electrode passes substantially sealingly through both of the orifices when the interrupter is in a closed position.

The electrode 40 is composed of an inner tubular member 47 having a plurality of fingers arranged in an annulus and carrying a set of contacts 48 at their ends, and an outer tubular member 49 co-axial with the inner tubular member 47 and having a plurality of fingers which extend axially beyond the contact set 48 and which carry at their ends a further set of contacts 50. When the interrupter is in its closed position, the contact sets 48 and 50 engage the external surface of the fixed electrode (which is tubular) at points axially spaced along the latter, so that during opening of the interrupter the fixed electrode disengages from the contact set 48 before it disengages from the contact set 50. A metal probe 51, which is electrically connected to both of the inner and outer tubular members 47 and 49, extends axially of the electrode 40 and terminates at a point intermediate the contact sets 48 and 50.

As is apparent from FIG. 9, the inner and outer tubular members 47 and 49 are radially spaced so that an annular gas flow passage 52 is formed therebetween which communicates with the exhaust passage 43 and which also communicates with an annular venting space between the contact sets 48 and 50. When the fixed electrode passes through the insulating orifice 42 during opening of the interrupter, gas from the passage 46 flows through the orifice 42 and into the exhaust passage 43 via the venting space and the passage 52.

FIG. 10 shows another form of downstream electrode assembly which is generally similar to that described above with reference to FIG. 9, similar parts being accorded the same reference numerals. In this embodiment, however, the electrode 40 is engageable with a fixed electrode similar to the electrode 20 in FIG. 7, and comprises a single set of contacts 53 which are carried on the ends of a plurality of fingers 54 arranged in a ring. Gaps between the fingers 54 provide venting spaces which communicate with the exhaust passage 43.

We claim:

1. A gas-blast type interrupter comprising:

(a) first and second electrodes, said first electrode having a tubular end on which two sets of contact formations are provided in an axially spaced apart relationship, said second electrode being slidably engaged by both of said sets of contact formations when said electrodes are in said closed position, and disengaging from one of said sets of contact formations before becoming disengaged from the other set of contact formations during movement of said contacts from said closed position towards said open position;

(b) means operative to move said first and second electrodes between a closed position in which said electrodes are in mutual electrical engagement and an open position in which said electrodes are mutually separated, movement of said electrodes from said closed position toward said open position causing an arc to be drawn therebetween;

(c) a tubular housing having an interior in which said first electrode is disposed;

(d) a guide surrounding said tubular housing, said guide and said tubular housing defining therebetween an annular chamber into which pressurized gas is supplied upon movement of said electrodes from said closed position toward said open position;

(e) means defining a first insulating orifice in said tubular housing through which said second electrode substantially sealingly passes when said electrodes are in said closed position, said second electrode passing out of the first insulating orifice during movement of said electrodes toward said open position thereby premitting said pressurized gas from the annular chamber to flow through the first insulating orifice into said interior of said tubular housing in a direction essentially along said arc; and (f) means defining a second insulating orifice in said guide through which said second electrode also substantially sealingly passes when said electrodes are in said closed position, said second electrode passing out of the second insulating orifice during movement of said electrodes towards said open position thereby permitting said pressurized gas from the annular chamber to flow through the second insulating orifice in a direction opposed to the direction of gas flow through the first insulating orifice, the first and second insulating orifices being co-axial and of essentially the same size.

2. The gas-blast type interrupter according to claim 1, wherein said one of said sets of contact formations form an incomplete annulus.

3. The gas-blast type interrupter according to claim 1, wherein said tubular end of said first electrode is disposed adjacent to the first insulating orifice, and venting spaces are defined in said tubular end between said two sets of contact formations.

4. The gas-blast type interrupter according to claim 3, wherein said tubular end of said first electrode is composed of a plurality of axial fingers arranged in an annulus in angularly spaced apart relation, some of said fingers being axially extended and carrying said other set of contact formations, the remaining fingers carrying said one set of contact formations.

5. The gas-blast type interrupter according to claim 3, wherein said tubular end of said first electrode is composed of an inner tubular member having a plurality of fingers arranged in an annulus and carrying said one set of contact formations, and an outer tubular member co-axial with said inner tubular member and having a plurality of fingers which extend axially beyond said one set of contact formations and which carry said other set of contact formations.

6. The gas-blast type interrupter according to claim 5, wherein the venting spaces are defined between said fingers of said outer tubular member.

7. The gas-blast type interrupter according to claim 5, wherein said inner and outer tubular members are radially spaced apart, and the venting space is annular and defined between said inner and outer tubular members.

8. A gas-blast type interrupter comprising:

(a) first and second electrodes, said first electrode including a first tubular portion having a first set of contact formations thereon and a probe surrounded by said first tubular portion, and said second electrode including a second tubular portion having a second set of contact formations thereon, said first set of contact formations slidably engaging said second electrode and said second set of contact formations slidably engaging said probe when said contacts are in said closed position, and said first set of contact formations disengaging from said second electrode before said second set of contact formations disengage from said probe during movement of said electrodes from said closed position toward said open position;

(b) means operative to move said first and second electrodes between a closed position in which said electrodes are in mutual electrical engagement and an open position in which said electrodes are mutually separated, movement of said electrodes from said closed position toward said open position causing an arc to be drawn therebetween;

(c) a tubular housing having an interior in which said first electrode is disposed;

(d) a guide surrounding said tubular housing, said guide and said tubular housing defining therebetween an annular chamber into which pressurized gas is supplied upon movement of said electrodes from said closed position toward said open position;

(e) means defining a first insulating orifice in said tubular housing through which said second electrode substantially sealingly passes when said electrodes are in said closed position, said second electrode passing out of the first insulating orifice during movement of said electrodes toward said open position thereby premitting said pressurized gas from the annular chamber to flow through the first insulating orifice into said interior of said tubular housing in a direction essentially along said arc; and (f) means defining a second insulating orifice in said guide through which said second electrode also substantially sealingly passes when said electrodes are in said closed position, said second electrode passing out of the second insulating orifice during movement of said electrodes toward said open position thereby permitting said pressurized gas from the annular chamber to flow through the second insulating orifice in a direction opposed to the direction of gas flow through the first insulating orifice, the first and second insulating orifices being co-axial and of essentially the same size.

* * * * *